US007527364B2

(12) United States Patent
Katayama

(10) Patent No.: US 7,527,364 B2
(45) Date of Patent: May 5, 2009

(54) PRINTER, LIQUID DISCHARGING HEAD, AND FLEXIBLE FLAT CABLE OF LIQUID DISCHARGING HEAD

(75) Inventor: Naoki Katayama, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 482 days.

(21) Appl. No.: 11/493,606

(22) Filed: Jul. 27, 2006

(65) Prior Publication Data

US 2007/0024679 A1 Feb. 1, 2007

(30) Foreign Application Priority Data

Jul. 28, 2005 (JP) ..... 2005-219422

(51) Int. Cl.
*B41J 2/045* (2006.01)

(52) U.S. Cl. ..... 347/70

(58) Field of Classification Search ..... 347/70, 347/68–69, 71–72, 50, 57–58; 400/124.16; 310/311

See application file for complete search history.

(56) References Cited

U.S. PATENT DOCUMENTS

| | | | | |
|---|---|---|---|---|
| 6,979,074 | B2 | 12/2005 | Watanabe et al. | |
| 2005/0285910 | A1* | 12/2005 | Sekiguchi | 347/71 |
| 2007/0002102 | A1* | 1/2007 | Kubo | 347/68 |

FOREIGN PATENT DOCUMENTS

| | | |
|---|---|---|
| JP | 2004-114342 | 4/2004 |

* cited by examiner

*Primary Examiner*—K. Feggins
(74) *Attorney, Agent, or Firm*—Baker Botts L.L.P.

(57) ABSTRACT

An ink-jet head includes a head main body including a channel unit in which a pressure chamber is formed, and a piezoelectric actuator having a piezoelectric deformation portion facing the pressure chamber, and an FPC which has a substrate and a plurality of wires, and which is arrange on an upper side of the piezoelectric actuator. A plurality of projections bent to form a projection toward the head main body is formed in the FPC. A front end of the projections is in contact with an area not facing the pressure chamber, on a surface of the piezoelectric actuator. Accordingly, it is possible to suppress hindering of a deformation of the piezoelectric deformation portion accompanied by a liquid discharge, due to a contact with a flexible flat cable.

14 Claims, 7 Drawing Sheets

PRINTER, LIQUID DISCHARGING HEAD, AND FLEXIBLE FLAT CABLE OF LIQUID DISCHARGING HEAD

CROSS REFERENCE TO RELATED APPLICATION

The present application claims priority from Japanese Patent Application No. 2005-219422, filed on Jul. 28, 2005, the disclosure of which is incorporated herein by reference in its entirety.

BACKGROUND OF THE INVENTION

1. Field of the Invention

The present invention relates to a printer which records images by discharging a liquid, a liquid discharging head which discharges a liquid from a liquid discharge port, and a flexible flat cable of the liquid discharging head.

2. Description of the Related Art

In U.S. Pat. No. 6,979,074, an ink-jet head in which drive electrodes (individual electrodes) are formed in areas of piezoelectric sheets, facing pressure chambers has been disclosed. In this ink-jet head, an actuator unit which is formed by stacking a plurality of piezoelectric sheets is attached to a channel unit in which a large number of nozzles and pressure chambers are formed. Moreover, each individual electrode formed on a surface of the actuator unit is electrically connected to a contact of a flexible cable (flexible flat cable) such as an FPC (Flexible Printed Circuit), a COF (Chip On Film) or a COP (Chip On Parts).

In the ink-jet head described in U.S. Pat. No. 6,979,074, the piezoelectric sheet undergoes unimorph deformation by a piezoelectric transverse effect at a time of an ink discharge. For improving a deformation efficiency of this deformation portion of the piezoelectric sheet, it is necessary to avoid the FPC from contacting with an area of the actuator unit, facing the pressure chamber. From such a point of view, in the ink-jet head described in U.S. Pat. No. 6,979,074, an electroconductive member called as a "land" which is thicker than the individual electrode is formed in an area of the piezoelectric sheet, not facing the pressure chamber, to be joined to the individual electrode, and the individual electrode and the contact formed in the FPC are electrically connected via the land. Furthermore, a large number of dummy electrodes are formed in a direction along a vertical edge of the piezoelectric sheet having a trapezoidal shape in a plan view. These dummy electrodes are joined to the contacts formed in the FPC.

SUMMARY OF THE INVENTION

However, in an ink-jet head described in U.S. Pat. No. 6,979,074, for joining the land, the dummy electrodes, and the contacts formed in the FPC, solder or a thermosetting electroconductive adhesive is used as a joining agent. Therefore, it is necessary to perform a heat treatment at a time of joining. However, at the time of the heat treatment, the FPC undergoes a downward deformation due to heat, and comes in contact with an area of a piezoelectric sheet, facing a pressure chamber. Even after the temperature is returned to an ordinary temperature, the deformation of the FPC is still maintained, and the FPC is not separated from the piezoelectric sheet. Therefore, at a time of an ink discharge, a deformation of a piezoelectric deformation portion is hindered, and an ink discharge property is declined (deteriorated).

Therefore, an object of the present invention is to provide a liquid discharging head which suppresses hindering of the deformation of the piezoelectric deformation portion accompanied by the ink discharge, due to the contact with the flexible flat cable, and a flexible flat cable of the liquid discharging head.

According to a first aspect of the present invention, there is provided a liquid discharging head which discharges a liquid, including a head body including a channel unit in which a plurality of pressure chambers, a plurality of liquid discharge ports, and a plurality of individual liquid channels reaching up to the liquid discharge ports via the pressure chambers respectively, are formed, and a plurality of piezoelectric deformation portions which have individual electrodes facing the pressure chambers respectively, and which are deformed when a predetermined voltage is applied to the individual electrodes; and a flexible flat cable arranged to cover the piezoelectric deformation portions and including a substrate which has a flexibility, in which a projection projecting toward the head body is formed; and a plurality of wires which are extended on the substrate and which are electrically connected to the individual electrodes.

The projection is in contact with an area of the head body which is different from areas faceing the pressure chambers.

According to the first aspect of the present invention, since the projection is formed in the flexible flat cable, the flexible flat cable and the piezoelectric deformation portion are isolated, and hardly come in contact. Therefore, a deformation of the piezoelectric deformation portion accompanied by the liquid discharge is hardly hindered by the flexible flat cable.

In the liquid discharging head of the present invention, the projection may be formed as a bent portion of the flexible flat cable which is bent to project toward the head body. In this case, since the projection is formed integrally with the substrate of the flexible flat cable, as compared to a case in which a projection is formed as a separate member is adhered to the substrate, there is no possibility of the projection coming off and falling apart from the substrate.

In the liquid discharging head of the present invention, the head body may include an actuator unit which includes the piezoelectric deformation portions and a piezoelectric layer which is formed to cover the pressure chambers and which supports the individual electrodes, and the projection may be in contact with an area, on a surface of the actuator unit, which is different from areas facing the pressure chambers. Accordingly, even when the projection is in contact with the actuator unit since a contact place is an area which is different from the piezoelectric deformation portion of the actuator unit, the flexible flat cable and the piezoelectric deformation portion are isolated, and hardly come in contact with each other. Therefore, a deformation of the piezoelectric deformation portion accompanied by the liquid discharge is hardly hindered by the flexible flat cable.

In the liquid discharging head of the present invention, the pressure chambers may have an elongated shape, and form a row of the pressure chambers which is arranged in a direction orthogonal to a longitudinal direction of the pressure chambers, and the projection may be in contact with a point area which is located in the vicinity of one end of the surface of the actuator unit in the longitudinal direction of the pressure chambers, and which is also located between two adjacent pressure chambers in a direction orthogonal to the longitudinal direction; and a width of the point area in the direction orthogonal to the longitudinal direction is not more than a distance between the two adjacent pressure chambers. Accordingly, since the projection is in contact with the point area on the surface of the actuator unit, near the pressure chambers, the flexible flat cable even upon bending, hardly makes a contact with the piezoelectric deformation portion. Moreover, since the projection takes a shape of a column making a contact with the point area, it is possible to form easily the projection in the flexible flat cable by a pressing (stamping) process using a punch etc. for example.

In the liquid discharging head of the present invention, the pressure chambers may have an elongated shape, and form a row of the pressure chambers which is arranged in a direction orthogonal to the longitudinal direction of the pressure chambers, and the projection may include a first projection and a second projection, the first projection being in contact with a first point area which is located in the vicinity of one end of the surface of the actuator unit in the longitudinal direction of the pressure chambers, and which is also located between two adjacent pressure chambers in the direction orthogonal to the longitudinal direction, and the second projection being in contact with a second point area which is located in the vicinity of the other end of the surface of the actuator unit in the longitudinal direction of the pressure chambers, and which is also located between the two adjacent pressure chambers in the direction orthogonal to the longitudinal direction, and a width of the first point area in the direction orthogonal to the longitudinal direction may not be more than a distance between the two adjacent pressure chambers, and a width of the second point area in the direction orthogonal to the longitudinal direction may not be more than a distance between the two adjacent pressure chambers. Accordingly, since the projection has the first projection and the second projection in a shape of a column, in contact with the first point area and the second point area, it is possible to form easily the projection in the flexible flat cable by a pressing (stamping) process using a punch etc., for example. Moreover, an area of the flexible flat cable, facing the pressure chamber hardly comes in contact with the piezoelectric deformation layer.

In the liquid discharging head of the present invention, the first projection and the second projection may be formed so as to include a plurality of first projections and a plurality of second projections respectively, and the first projections and the second projections may be formed at uniform distance in the direction orthogonal to the longitudinal direction. Accordingly, since the first projections and the second projections are arranged regularly, it is possible to form easily the first projections and the second projections in the flexible flat cable, and an area of the flexible flat cable, facing the pressure chambers hardly comes in contact with the piezoelectric deformation portions, all the more.

In the liquid discharging head of the present invention, the first projections and the second projections may be arranged alternately in the direction orthogonal to the longitudinal direction, so as to be arranged in a zigzag form. Accordingly, since the first projections and the second projections are arranged in the staggered form (zigzag form), it is possible to form easily the flexible flat cable, and the first projections and the second projections.

In the liquid discharging head of the present invention, the pressure chambers may have an elongated shape and form a row of the pressure chambers which is arranged in a direction orthogonal to a longitudinal direction of the pressure chambers, and the projection may be formed to have a long shape extended along the direction orthogonal to the longitudinal direction of the pressure chambers, and may be in contact with an elongated area, which is located in the vicinity of one end of the surface of the actuator unit in the longitudinal direction of the pressure chambers belonging to the row of the pressure chambers, and which is extended in the direction orthogonal to the longitudinal direction. Accordingly, the formation of the projection becomes easy, and the area of the flexible flat cable, facing the pressure chambers hardly comes in contact with the piezoelectric deformation portions, all the more.

In the liquid discharging head of the present invention, the pressure chambers may have an elongated shape, and may form a row of the pressure chambers which is arranged in a direction orthogonal to a longitudinal direction of the pressure chambers, and the projection may be formed to have a ring shape and may be in contact with a ring shaped area which is located on the surface of the actuator unit, and which surrounds a pressure chamber among the pressure chambers belonging to the row of the pressure chambers. Accordingly, since the projection is formed to be ring shaped, the flexible flat cable hardly comes in contact with the piezoelectric deformation portion surrounded by the projection, or the piezoelectric deformation portion facing the pressure chambers.

In the liquid discharging head of the present invention, the pressure chambers may have an elongated shape, and may form a row of the pressure chambers which is arranged in a direction orthogonal to a longitudinal direction of the pressure chambers, and the projection may be formed to have a shape of a ladder, and may be in contact with two elongated areas and a contacting area, the elongated areas being located in proximity to one end and the other end of the surface of the actuator unit in the longitudinal direction of the pressure chambers belonging to the row of the pressure chambers, and the elongated areas being extended in the direction orthogonal to the longitudinal direction, and the connecting area being located in a portion of the surface of the actuator unit corresponding between two pressure chambers among the pressure chambers is extended, and the connecting area connecting the two elongated areas. Accordingly, since the projection is formed to have the shape of the ladder, a plurality of areas of the flexible flat cable, facing the pressure chamber, and the piezoelectric deformation portions surrounded by the projection hardly come in contact with each other.

In the liquid discharging head of the present invention, the substrate may be formed of a resin material, and the projection may be formed by a pressing process. Accordingly, it is possible to form the projection in the flexible flat cable by a simple method of formation such as the pressing (stamping) process.

According to a second aspect of the present invention, there is provided a flexible flat cable of a liquid discharging head connected to a head body including a channel unit in which a plurality of pressure chambers, a plurality of liquid discharge ports, and a plurality of individual liquid channels reaching up to the liquid discharge ports via the pressure chambers respectively, are formed, and a plurality of piezoelectric deformation portions having individual electrodes facing the pressure chambers respectively, the flexible flat cable covering the piezoelectric deformation portions, and supplying a driving signal to a plurality of individual electrodes, the flexible flat cable including:

a substrate which has a flexibility, which makes a contact with an area which does not face the pressure chambers when connected to the head main body, and in which a projection projecting toward the head main body is formed; and a plurality of wires which are extended on the substrate and are electrically connected to the individual electrodes respectively.

According to the second aspect of the present invention, since the projection is formed in the flexible flat cable, when the flexible flat cable is connected to the head main body, covering the piezoelectric deformation portions, the flexible flat cable and the piezoelectric deformation portions are isolated from each other, and hardly come in contact. Therefore, the deformation of the piezoelectric deformation portion accompanied by an ink discharge is hardly hindered by the flexible flat cable.

In the flexible flat cable of the liquid discharging head of the present invention, the projection may be formed as a bent portion of the flexible flat cable which is bent to project toward the head body. In this case, since the projection is formed integrally with the substrate of the flexible flat cable, as compared to a case in which a projected is formed as a separate member is adhered to the substrate, a mechanical strength is enhanced.

According to a third aspect of the present invention, there is provided a printer which records an image on a recording medium by discharging an ink, including a liquid discharging head having a head body including a channel unit in which a plurality of pressure chambers, a plurality of liquid discharge ports, and a plurality of individual liquid channels reaching up to the liquid discharge ports via the pressure chambers respectively, are formed, and a plurality of piezoelectric deformation portions which has individual electrodes facing the pressure chambers, and which are deformed when a predetermined voltage is applied to the individual electrodes; and a flexible flat cable arranged to cover the piezoelectric deformation portions and including a substrate which has a flexibility and on which a projection projecting toward the head body is formed, and a plurality of wires extended on the substrate and electrically connected to the individual electrodes, a carriage which is movable while supporting the liquid discharging head; and a control mechanism which is connected to one end of the flexible flat cable, which supplies a predetermined voltage to the individual electrodes, and which supplies a signal to the carriage for controlling a drive of the carriage.

The projection is in contact with an area of the head body which is different from areas facing the pressure chambers. In this case, since the projection is formed in the flexible flat cable, when the flexible flat cable is connected to the head main body, covering the piezoelectric deformation portions, the flexible flat cable and the piezoelectric deformation portion are isolated from each other, and hardly come in contact. Therefore, since the deformation of the piezoelectric deformation portion, accompanied by a liquid discharge is hardly hindered by the flexible flat cable, it is possible to realize a printer having excellent printing characteristics.

DETAILED DESCRIPTION OF THE PREFERRED EMBODIMENTS

Exemplary embodiments of the present invention will be described below while referring to diagrams.

Figure 1:
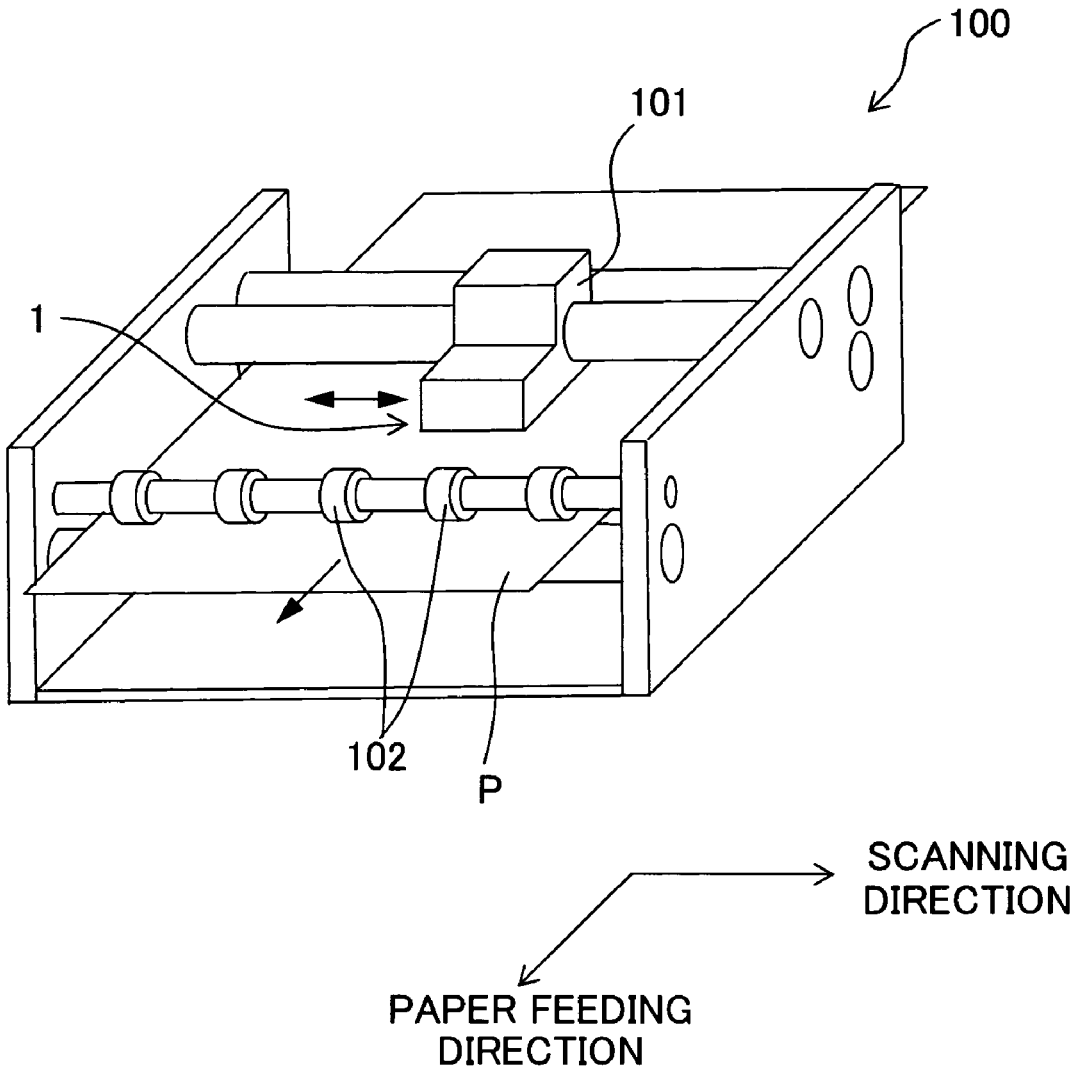
FIG. 1 is a schematic perspective view of an ink-jet printer in which an ink-jet head according to a first embodiment of the present invention is used.

A first embodiment is an example in which, the present invention is applied to an ink-jet head, which discharges an ink on to a recording paper from nozzles (liquid discharge ports), as a liquid discharging head. FIG. 1 is a schematic perspective view of an ink-jet printer in which the ink-jet head according to the first embodiment of the present invention is used. As shown in FIG. 1, an ink-jet printer 100 includes a carriage 101 which is movable in a scanning direction (left and right direction in FIG. 1), an ink-jet head 1 of serial type which is provided on the carriage 101 and discharges ink on to a recording paper P, and transporting roller 102 which carry the recording paper P in a paper feeding direction (forward direction in FIG. 1). The ink-jet head 1 moves integrally with the carriage 101 in the scanning direction, and discharges ink on to the recording paper P from nozzles 20 (refer to FIG. 5) formed in an ink discharge surface on a lower surface of the ink-jet head 1. The recording paper P with an image recorded thereon by the ink-jet head 1 is discharged in the paper feeding direction by the transporting rollers 102.

Figure 2:
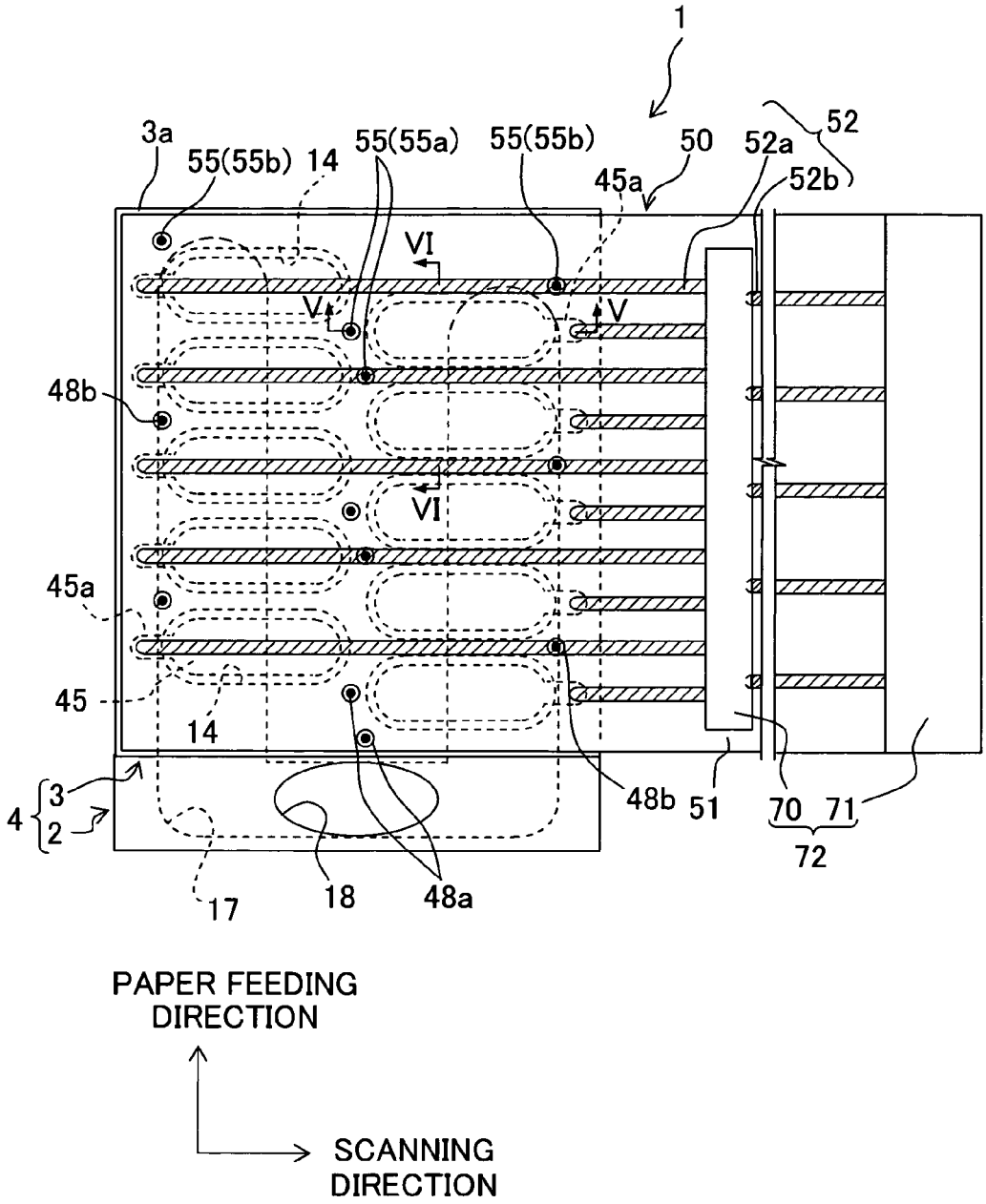
FIG. 2 is a plan view of the ink-jet head
Figure 3:
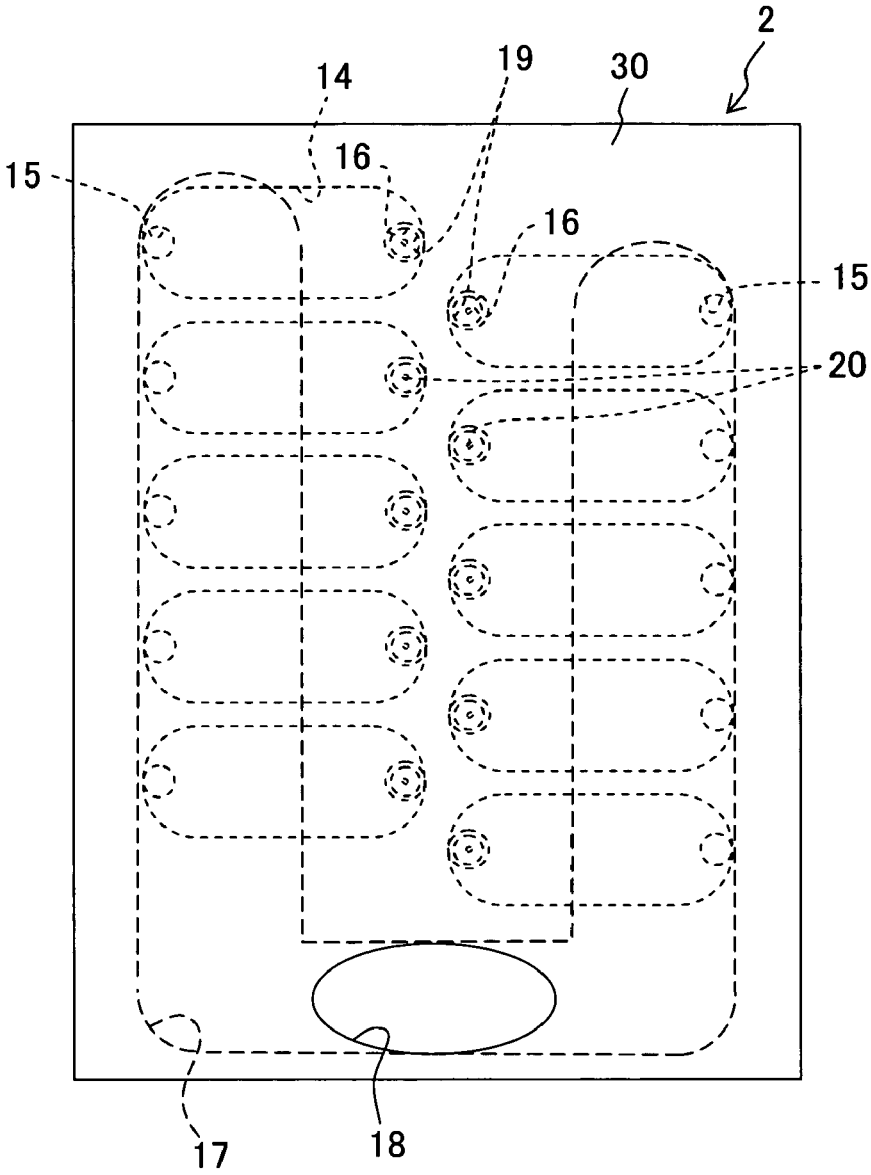
FIG. 3 is a plan view of a lower side portion from a vibration plate, of the ink-jet head shown in FIG. 2.
Figure 3:
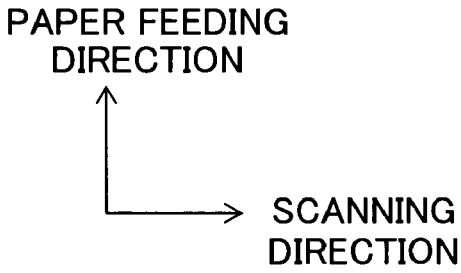
Figure 4:
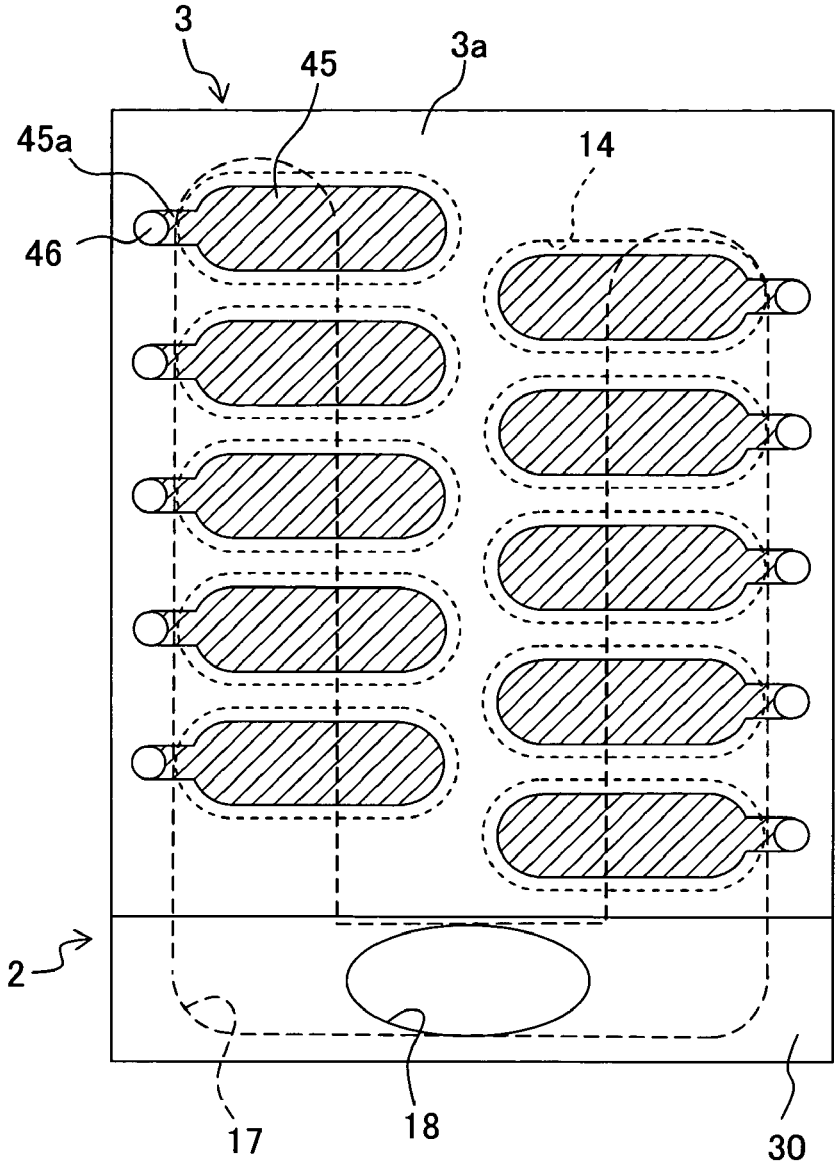
FIG. 4 is a plan view of a lower side portion from a piezoelectric actuator, of the ink-jet head shown in FIG. 2.
Figure 4:
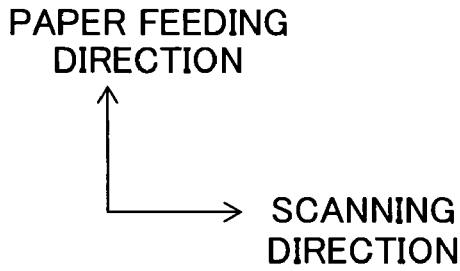
Figure 5:
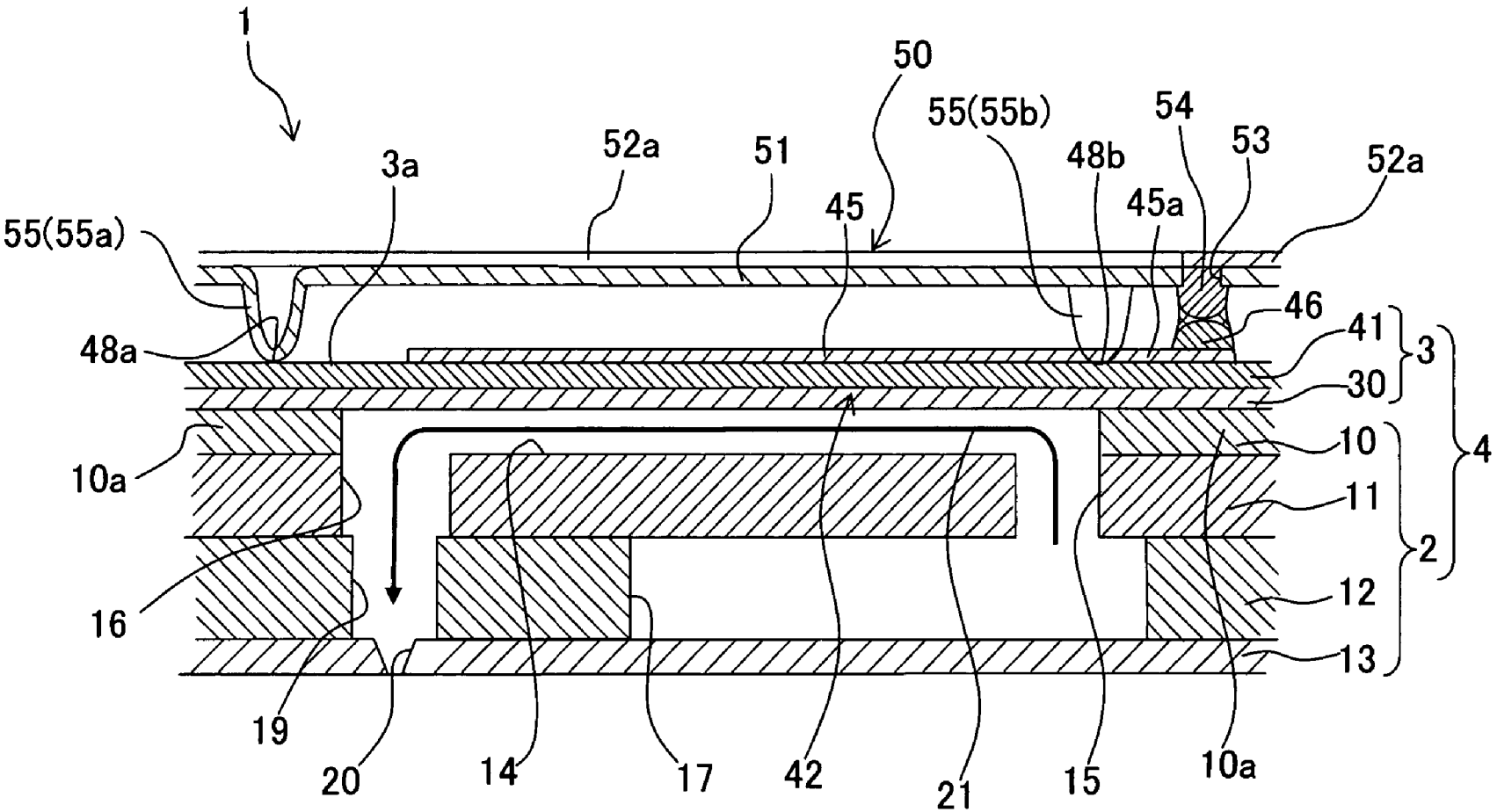
FIG. 5 is a partial cross-sectional view taken along a line V-V shown in FIG. 2.
Figure 6:
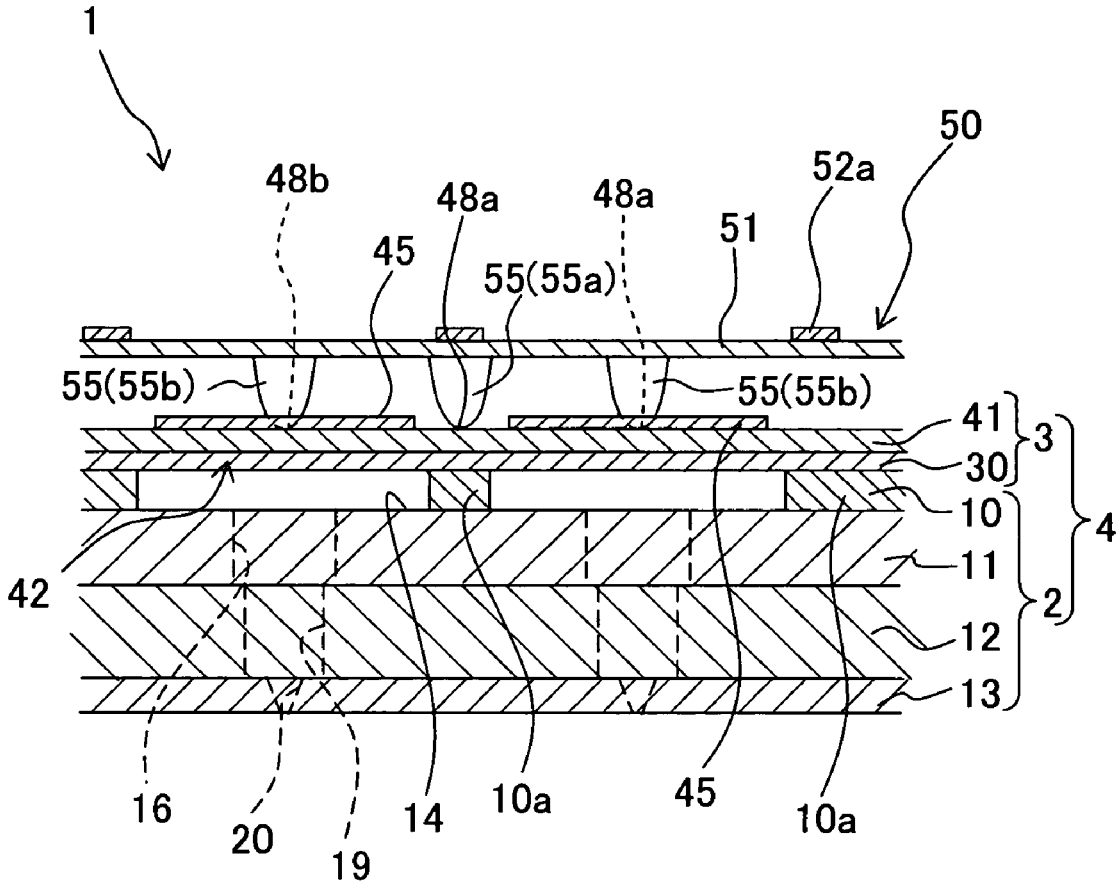
FIG. 6 is a partial cross-sectional view taken along a line VI-VI shown in FIG. 2.

Next, the ink-jet head 1 will be described in detail with reference to FIG. 2 to FIG. 6. FIG. 2 is a plan view of the ink-jet head 1. FIG. 3 is a plan view of a lower side portion from a vibration plate 30, of the ink-jet head 1. FIG. 4 is a plan view of a lower side portion from a piezoelectric actuator, of the ink-jet head 1 shown in FIG. 2. FIG. 5 is a partial cross-sectional view taken along a line V-V shown in FIG. 2. FIG. 6 is a partial cross-sectional view taken along a line VI-VI shown in FIG. 2. As shown in FIG. 2 to FIG. 6, the ink-jet head 1 includes a head main body 4 including a channel unit 2 in which ink channels are formed, and a piezoelectric actuator (actuator unit) 3 arranged on an upper side of the channel unit 2, and a flexible printed circuit (FPC) 50 arranged on an upper side of the piezoelectric actuator 3.

Firstly, the channel unit 2 will be described. As shown in FIG. 5 and FIG. 6, the channel unit 2 includes a cavity plate 10, a base plate 11, a manifold plate 12, and a nozzle plate 13, and these four plates are joined in stacked layers. Among these four plates 10 to 13, the cavity plate 10, the base plate 11, and the manifold plate 12 are stainless steel plates of a substantially rectangular shape. Moreover, the nozzle plate 13 is formed of a high-molecular synthetic resin material such as polyimide for example, and is joined to a lower surface of the manifold plate 12.

As shown in FIG. 2, in the cavity plate 10, a plurality of pressure chambers 14 arranged along a plane is formed. These pressure chambers 14 are open toward the vibration plate (upward in FIG. 5) 30 which will be described later. Moreover, the pressure chambers 14 are arranged in two rows in staggered (zigzag) array in the paper feeding direction (vertical direction in FIG. 2). Each pressure chamber 14 is substantially elliptical in a plan view with a longitudinal axis in the scanning direction (left and right direction in FIG. 2).

As shown in FIG. 3, communicating holes 15 and 16 are formed in the base plate 11 at positions which overlap in a plan view with both end portion of the pressure chamber 14 in the longitudinal direction. Moreover a manifold channel 17 extending in two rows in the paper feeding direction, which overlaps with one of left and right end portions of the pressure chamber 14 in a plan view, is formed in the manifold plate 12. Ink is supplied to the manifold channel 17 from an ink tank (not shown in the diagram) via an ink supply port 18 formed in the cavity plate 10 and the vibration plate 30 which will be described later. Moreover, communicating holes 19 are formed in the manifold plate 12, at a position overlapping with an end portion of the pressure chamber 14, on a side opposite to the manifold channel 17, in a plan view. Furthermore, a plurality of nozzles 20 are formed in the nozzle plate 13 at positions overlapping with a plurality of communicating holes 19, in a plan view. The nozzles 20 are formed by means of an excimer laser process on a substrate of a high-molecular synthetic resin such as polyimide for example. Moreover, as shown in FIG. 3, the nozzles 20 communicate with the pressure chambers 14 belonging to one of the two rows of the pressure chambers 14, at a right end portion in the longitudinal direction of the pressure chamber 14, and the nozzles 20 communicates with the pressure chambers 14 belonging to the other row of the pressure chambers, at a left end portion in the longitudinal direction of the pressure chamber 14.

Moreover, as shown in FIG. 4, the manifold channel 17 communicates with the pressure chambers 14 via the communicating holes 15 respectively, and the pressure chambers 14 communicates with the nozzles 20 via the communicating holes 16 and 19 respectively. Thus, a plurality of individual ink channels (individual liquid channels) 21 from the manifold 17 to the nozzles 20 via the pressure chambers 14 are formed in the channel unit 2.

Next, the piezoelectric actuator 3 will be described below. As shown in FIG. 4 to FIG. 6, the piezoelectric actuator 3 includes the vibration plate 30, a piezoelectric layer 41, and a plurality of individual electrodes 45. The vibration plate 30 which has a substantially rectangular shape is joined to an upper surface of the cavity plate. The piezoelectric layer 41 is formed on an upper surface of the vibration plate 30, continuously spreading over the pressure chambers 14. The individual electrodes 45 are formed on an upper surface of the piezoelectric layer 41, corresponding to the pressure chambers 14. Moreover, the piezoelectric actuator 3 has a plurality of piezoelectric deformation portions 42 including an area of the piezoelectric layer 41 facing the pressure chamber 14, and the individual electrodes 45 corresponding to the pressure chambers 14.

The vibration plate 30 which covers the pressure chambers 14 is made of a metallic material such as an iron alloy like stainless steel, a nickel alloy, an aluminum alloy, and a titanium alloy, and is joined to partition walls 10*a* which define pressure chambers 14. This vibration plate 30 facing the individual electrodes 45, also servers as a common electrode which generates an electric field in the piezoelectric layer 41 between the individual electrodes 45 and the vibration plate 30, and the vibration plate 30 is earthed to keep at a ground electric potential.

The piezoelectric layer 41 is composed of mainly lead zirconate titanate (PZT) which is a ferroelectricity and is a solid solution of lead titanate and lead zirconate. The piezoelectric layer 41 is formed spreading over the pressure chambers 14. Therefore, it is possible to form the piezoelectric layer 41 for all the pressure chambers 14 at a time, and the formation of the piezoelectric layer 41 becomes easy. Here, the piezoelectric layer 41 can be formed by an aerosol deposition method (AD method) in which very fine particles of a piezoelectric material are deposited on the upper surface of the vibration plate 30 by causing to collide at a high speed. Alternatively, a sol-gel method, a sputtering method, a hydrothermal synthesis method, or a CVD (chemical vapor deposition) method can also be used for forming the piezoelectric layer 41. Furthermore, the piezoelectric layer 41 can also be formed by adhering on the upper surface of the vibration plate 30 a piezoelectric sheet which is obtained by baking a green sheet of PZT.

The individual electrodes 45 having a substantially elliptic shape and a size slightly smaller than the pressure chambers 14 in a plan view are formed corresponding to the pressure chambers 14 on the upper surface of the piezoelectric layer 41. The individual electrodes 45 are formed to overlap with central portions of the corresponding pressure chambers 14 in a plan view, respectively. The individual electrodes 45 are made of an electroconductive material such as gold, copper, silver, palladium, platinum, and titanium. Furthermore, on the upper surface of the piezoelectric layer 41, a plurality of drawn portions 45*a* drawn from an end portion of the individual electrodes 45 (outer side portion in the scanning direction in a plan view) up to portions not facing the pressure chambers 14 in a plan view (portions facing the partition walls 10*a*) are formed. More concretely, as shown in FIG. 2, from the individual electrodes 45 corresponding to the pressure chambers 14 on the left side row, the drawn portions 45*a* are drawn toward a left side, and from the individual electrodes 45 corresponding to the pressure chambers 14 on the right side row, the drawn portions 45*a* are drawn toward the right side. The individual electrodes 45 and the drawn portions 45*a* can be formed by a method such as a screen printing, the sputtering method, and a vapor deposition method, for example. Moreover, lands 46 having a circular shape in a plan view are formed on the drawn portions 45*a*. The lands 46 are formed of a material such as gold including glass flit for example.

Next, the FPC 50 will be described below. As shown in FIG. 2, FIG. 5, and FIG. 6, the FPC (flexible flat cable) 50 includes a substrate 51 extending from a position facing an upper surface (surface) 3*a* of the piezoelectric actuator 3 up to a control section 71, and a plurality of wires 52 formed along a direction in which the substrate 51 is extended (scanning direction in FIG. 2). A driver IC 70 is mounted on the substrate 51. Here, a control mechanism 72 which is formed by including the control section 71 and the driver IC 70 supplies a predetermined voltage to the individual electrodes 45, and a signal to the carriage 101 which controls a drive of the carriage 101. The wires 52 includes a plurality of individual wires 52*a* which electrically connect the individual electrodes 45 and the driver IC 70, and a plurality of signal wires 52*b* which electrically connect the driver IC 70 and the control section 71. The wires 52 are formed on an upper surface of the substrate 51. The substrate 51 is formed in a form of a thin plate so as to face the entire upper surface 3*a* of the piezoelectric actuator 3. Accordingly, the FPC 50 is arranged to cover the piezoelectric deformation portions 42 formed in the piezoelectric actuator 3. Moreover, the substrate 51 is formed of a material such as a polyimide resin, and is flexible and insulative. As shown in FIG. 5, a plurality of through holes 53 extending in a direction of thickness of the substrate 51 is formed in the substrate 51. These through holes 53 are formed in the substrate 51 at positions facing the lands 46. Terminals 54 are formed in through holes 53 to protrude from a lower surface of the substrate 51. The terminals 54 are electrically connected to individual wires 52*a* via the through holes 53. Terminals 54 of the FPC 50 are joined (connected) to the lands 46 via a solder or an electroconductive adhesive. According to this structure, the driver IC 70 outputs a driving signal to individual electrodes 45 via the individual wires 52*a*, the driving signal is a parallel signal of a predetermined voltage which is converted from a printing signal subjected to serial transfer from the control section 71.

As shown in FIG. 5 and FIG. 6, a plurality of projections 55 projecting toward the upper surface 3*a* of the piezoelectric actuator 3 are formed on an area of the FPC 50 facing the piezoelectric actuator 3. In the first embodiment, these projections 55 are formed by performing a pressing (stamping) process on the FPC 50 by using a male (metallic) mold having a rod-shaped member with a round front end, and a female (metallic) mold having a hole in which the rod-shaped member can be fitted (both molds not shown in the diagram). The projections 55 are projected toward the upper surface 3*a* of the piezoelectric actuator 3, and are bent in the rod form having the round front end. Moreover, front ends of the projections 55 are in contact with areas of the piezoelectric layer 41 not facing the pressure chambers 14. Concretely, the front ends of the projections 55 are in contact with point areas (first point areas) 48*a* near one end (end portion on a side communicating with the nozzles 20) of the pressure chambers 14 in the longitudinal direction (scanning direction), and point areas (second point areas) 48*b* near the other end (end portion on a side opposite to the end portion on the side communicating with the nozzles 20) of the pressure chambers 14 in the longitudinal direction, and front ends of the projections 55 are between the two adjacent pressure chambers in the paper feeding direction (direction orthogonal to the longitudinal direction of the pressure chamber 14) on the upper surface of the piezoelectric layer 41 (the upper surface 3*a* of the piezoelectric actuator 3) facing the FPC 50. In other words, the projections 55 include a plurality of projections (first projections) 55*a* which are in contact with the first point areas 48*a*, and a plurality of projections (second projections) 55*b* which are in contact with the second point areas 48*b*. As shown in FIG. 5, the front ends of the projections 55 have a tapered shape, and as shown in FIG. 2, a diameter at a base of each of the projections 55 is substantially the same as a gap between the two adjacent pressure chambers 14 in the paper feeding direction. Therefore, a width of the point areas 48*a* and 48*b* in contact with the front end of the projection 55 is less (shorter) than the gap between the two adjacent pressure chambers 14 in the paper feeding direction. Moreover, as shown in FIG. 2, the projections 55*a* and 55*b* are arranged at the same interval along the direction orthogonal to the longitudinal direction of the pressure chambers 14 (direction of a row of the pressure chambers 14). A row of the projections 55*a* is arranged near one end of the pressure chamber 14 in the longitudinal direction, and a row of the projections 55*b* is arranged near the other end of the pressure chamber 14 in the longitudinal direction. Moreover, the projections 55*a* and 55*b* belonging to these two rows are arranged in a staggered form (zigzag form) along the direction of row of the pressure chambers 14. The two rows arranged in such manner are formed corresponding to the rows of the pressure chambers 14 respectively, and four rows made of the projections 55*a* and 55*b* are formed on the FPC 50.

Next, an action of the piezoelectric layer 3 will be described below. At a time of printing an image on the paper P, a printing signal is supplied from the control section 71 to the driver IC 70. Moreover, the driver IC 70 converts the printing signal to a driving signal which includes information of voltage to be applied to individual electrodes, and outputs the driving signal to each individual electrode 45 via the individual wire 52*a*. At this time, since the vibration plate 30 is kept at the ground electric potential, an electric potential difference is generated between the vibration plate 30 and the individual electrode 45. Then an electric field in a direction of thickness is generated in areas of the piezoelectric layer 41 sandwiched between the individual electrodes 45 and the vibration plate 30, and the piezoelectric layer 41 is contracted in a horizontal direction which is perpendicular to a direction of thickness which is a direction in which the piezoelectric layer 41 is polarized. With the contraction of the piezoelectric layer 41, a distortion in a direction of stacking is developed in areas facing the pressure chambers 14 of the vibration plate 30 and the piezoelectric deformation portions 42, and the ink is discharged from the nozzles 20 corresponding to the individual electrodes 45. Thus, a predetermined printing is performed on the recording paper P.

As it has been described above, according to the ink-jet head 1 in the first embodiment, the projections 55 are formed in the FPC 50, and the front ends of the projections 55 are in contact with the upper surface 3*a* of the of the piezoelectric actuator 3 excluding the areas facing the pressure chambers 14. Therefore, even when the FPC 50 and the piezoelectric actuator 3 are electrically connected, there is a gap between the FPC 50 and the piezoelectric deformation portions 42 of the piezoelectric actuator 3. Therefore, even when the piezoelectric deformation portions 42 are deformed accompanied by the ink discharge, the FPC 50 and the piezoelectric deformation portion 42 hardly come in contact with each other. Consequently, the deformation of the piezoelectric deformation portions 42 are hardly hindered by the FPC 50, and the ink discharge characteristics are stable.

Moreover, since the projections 55*a* and 55*b* have a shape of a column to make a contact with the point areas 48*a* and 48*b*, it is possible to form easily the projections 55 in the FPC 50 by a pressing (stamping) process by using a punch etc. Moreover, since the projections 55*a* are in contact with the point areas 48*a* in the area of the piezoelectric layer 41, facing an area near one end of the piezoelectric layer 41 in the longitudinal direction, the FPC 50 and the piezoelectric deformation portions 42 are isolated from each other. In other words, since the piezoelectric deformation portions 42 are formed in the areas facing the pressure chambers 14, and point areas 48*a* are near the pressure chamber 14, even when the FPC 50 is bent, the FPC 50 hardly makes a contact with the piezoelectric deformation portions 42. Moreover, since the projections 55*a* and 55*b* are in contact with the point areas 48*a* and 48*b* in the areas of the piezoelectric layer 41 facing the areas near both ends of the pressure chambers 14 in the longitudinal direction, the areas of the FPC 50 facing the pressure chambers 14, and the piezoelectric deformation portion 42 hardly make a contact with each other.

Moreover, since the rows of the projections 55*a* and the rows of the projections 55*b* are arranged regularly at a uniform interval along the direction orthogonal to the longitudinal direction of the pressure chambers 14, it is possible to form easily the projections 55 in the FPC 50. In addition, the areas of the FPC 50 facing the pressure chambers 14, and the piezoelectric deformation portions 42 hardly come in contact with each other. Moreover, since the projections 55*a* and the projections 55*b* are arranged in the staggered form (zigzag form) corresponding to the rows of the pressure chambers 14, even without forming too many projections 55 in the FPC 50, it is possible to avoid the areas of the FPC 50 facing the pressure chambers 14 and the piezoelectric deformation portions 42 from contacting with each other. Therefore, it is possible to form easily the projections 55 in the FPC 50.

Second Embodiment

Figure 7:
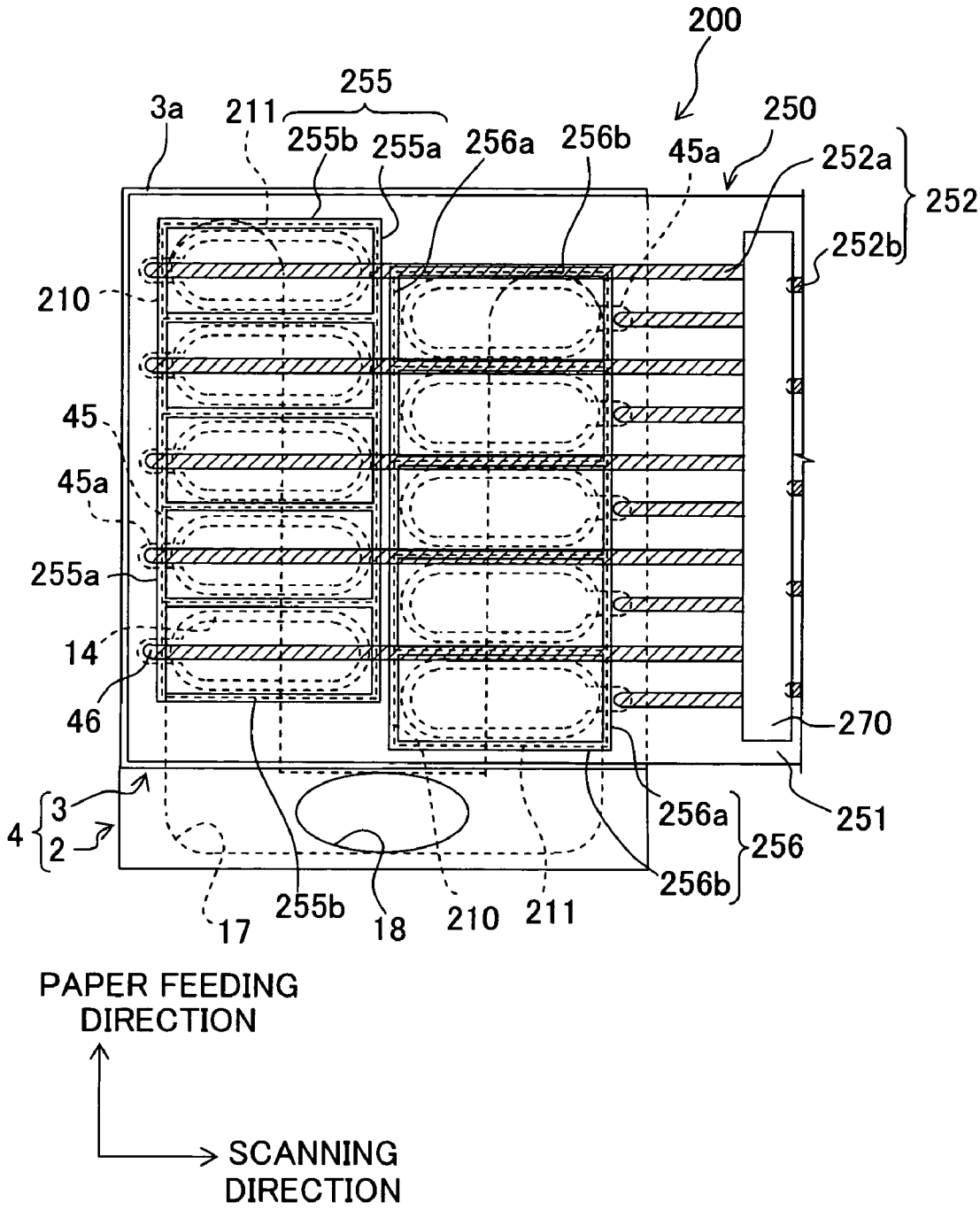
FIG. 7 is a plan view of an ink-jet head according to a second embodiment of the present invention.

Next, an ink-jet head 200 according to a second embodiment will be described below. FIG. 7 is a plan view of the ink-jet head 200 according to the second embodiment. Since components (head main body 4) of the ink-jet head 200, except an FPC 250 are similar to the components in the first embodiment, the same reference numerals are used for these components, and the description of such components is omitted to avoid repetition. The FPC 250 of the ink-jet printer 200, as shown in FIG. 7, includes a substrate 251 similar to the substrate 51, and wires 252 formed on the substrate 251, which is similar to the wires 52. A driver IC 270 is mounted on the substrate 251. The wires 252 include a plurality of individual wires 252*a* which electrically connect for each individual electrode 45, and the driver IC 270, and a plurality of signal wires 252*b* which electrically connect the driver IC 270 and a control section (not shown in the diagram). The substrate 251 is a thin plate facing the entire upper surface 3*a* of the piezoelectric actuator 3. Moreover, through holes (not shown in the diagram) are formed in the individual electrodes 45 in areas facing the lands 46 formed on the drawn portions 45*a*, and terminals (not shown in the diagram) are formed in through holes to protrude from a lower surface of the substrate 251, respectively. The terminals are electrically connected to the individual wires 252*a* via the through holes formed in the substrate 251, and are joined (connected) to the lands 46 via a solder or an electroconductive adhesive. According to this structure, similarly as in the first embodiment, the driver IC 270 outputs driving signal which is a printing signal subjected to serial transfer from the control section, converted to a parallel signal of a predetermined voltage, to individual electrodes 45 via the individual wires 252*a*. Accordingly, similarly as in the first embodiment, a distortion in a direction of stacking is developed in the areas facing the pressure chambers 14, of the vibration plate 30 and the piezoelectric deformation portions 42, and the ink is discharged from the nozzles 20 corresponding to the individual electrodes 45. Thus, a predetermined printing is performed on the recording paper P.

In areas of the FPC 250 facing the piezoelectric actuator 3, as shown in FIG. 7, two kinds of projections 255 and 256 projecting toward the upper surface 3*a* of the piezoelectric actuator 3, and corresponding to two rows of the pressure chambers 14 formed by the pressure chambers 14 formed along the paper feeding direction are formed. Moreover, elongated areas 210 and a connecting area 211 are formed in areas of the piezoelectric actuator 3, overlapping with the two kinds of projections 255 and 256. The elongated areas 210 are areas in a form of a line extending in the paper feeding direction, positioned near both ends of the pressure chambers 14 in the longitudinal direction, and the connecting areas 211 are areas in a form of a line extended along the scanning direction, which connect the elongated areas 210 so as to form ring shaped areas which surround separately the elongated areas 210 and pressure chambers 14, on the upper surface 3*a* of the piezoelectric actuator 3. Moreover, the two kinds of projections 255 and 256 include elongated portions 255*a* and 256*a*, front ends of which make a contact with the elongated areas 210, and connecting portions 255*b*, and 256*b*, front ends of which make a contact with the connecting areas 211. The projections 255 are formed by the elongated portions 255*a* and the connecting portions 255*b* getting connected, and the projections 256 are formed by the elongated portions 256*a* and the connecting portions 256*b* getting connected. In other words, each of the projections 255 and 256 is formed in a shape of a ladder corresponding to each row of the pressure chambers, and a circumference of each pressure chamber 14 is surrounded by the projections 255 and 256. Moreover, the projections 255 and 256 can be formed by bending the substrate 251 and the individual wires 252*a* toward the upper surface 3*a* of the piezoelectric actuator 3 by performing the pressing (stamping) process on the FPC 250 by using a male (metallic) mold having a protrusion projected in the form (shape) of a ladder, and a female (metallic) mold having a recess in the form of a ladder in which the protrusion of the male (metallic) mold can be fitted (not shown in the diagram)

As it has been described above, according to the ink-jet head 200 of the second embodiment, the two kinds of projections 255 and 256 in the form of a ladder are formed in the FPC 250, the front ends of the projections 255 and 256 are in contact with the areas on the upper surface 3*a* of the piezoelectric actuator 3, facing the pressure chambers 14. Therefore, similarly as in the first embodiment, even when the FPC 250 and the piezoelectric actuator 3 are electrically connected, the FPC 250 and the piezoelectric deformation portions 42 of the piezoelectric actuator 3 are isolated from each other. Consequently, the deformation of the piezoelectric deformation portions 42 accompanied by the ink discharge is hardly hindered by the FPC 250, and the stable ink discharge characteristics can be achieved. Moreover, since the projections 255 and 256 have the elongated portions 255*a* and 256*a*, the areas of the FPC 250 facing the pressure chambers 14, and the piezoelectric deformation portions 42 hardly make a contact with each other. In addition, since the elongated portions 255*a* and 256*a* can be formed at a time by the pressing (stamping) process, the formation of the elongated portions 255*a* and 256*a* becomes easy. Furthermore, since the projections 255 and 256 include the connecting portions 255*b* and 256*b* having the front end in contact with the ring shaped areas including the elongated areas 210 and the connecting areas 211, and since the projections 255 and 256 are formed to be ring shaped, the FPC 250 and the piezoelectric deformation portions 42 facing the pressure chambers 14, surrounded by the projections 255 and 256 hardly come in contact with each other. Moreover, since the projections 255 and 256 are formed to be ladder shaped, the areas of the FPC 250 facing the pressure chambers 14, and the piezoelectric deformation areas 42 surrounded by the projections 255 and 256 hardly come in contact with each other.

The exemplary embodiments of the present invention have been described above. However, the present invention is not restricted to the embodiments mentioned above, and various modifications which fairly fall within the basic teachings herein set forth are possible. For example, in the first embodiment and the second embodiment, the front ends of the projections 55, 255, and 256 of the FPCs 50 and 250 are in contact with the upper surface 3*a* of the piezoelectric actuator 3. However, when the piezoelectric layer is formed mutually isolated corresponding to each pressure chamber 14, the front end of the projections may not be in contact with the vibration plate. Moreover, the front end of the projections may be in contact with areas comparatively away from the pressure chambers 14 (peripheral portions of the piezoelectric layer 41 for example), on the upper surface 3*a* of the piezoelectric actuator 3. Furthermore, at least two projections from among the projections 55, 255, and 256 are formed in the FPCs 50 and 250 in each embodiment. However, at least one projection may be formed in the FPC. Moreover, the projections 55 may not be arranged at the uniform interval along the paper feeding direction. Furthermore, the projections 55 may not be arranged in the staggered form (zigzag form) along the paper feeding direction. Moreover, in the first embodiment, the projections 55*a* and 55*b* are formed making rows near both ends of the pressure chambers 14 in the longitudinal direction. However, the rows of projections 55*a* and 55*b* may not be required to be necessarily formed near the both ends, and the projections 55*a* may be formed only near one end of a side of the individual electrodes 45, toward which the drawn portions 45*a* is not drawn. In other words, in FIG. 2, a configuration may be such that two rows of the projections 55*a* are formed only between the two rows of the pressure chambers 14. In this case, since all the projections 55*a* are positioned away from the land portions 46 formed in the drawn portions

45*a*, a possibility of hindering a solder joint between the terminals 54 of the FPC 50 and the lands 46 are eliminated. Moreover, the projections 255 and 256, the elongated portions 255*a* and 256*a*, and the connecting portions 255*b* and 256*b* are formed in the form of a ladder upon being connected. However, the projection may include only the elongated portions 255*a* and 256*a*, or the projection may include only the connecting portions 255*b* and 256*b*. Moreover, the projections 255 and 256 of the second embodiment are formed surrounding pressure chambers 14. However, the projections may be ring shaped projections surrounding two or more pressure chambers 14 together. Furthermore, in the first embodiment and the second embodiment, the projections were bent portions formed in the substrate of the FPC by the pressing (stamping) process performed by using a punch etc. However, without restricting to such formation, the projections may be formed by adhering to the substrate of the FPC a protruding member formed by a material such as a resin or a rubber. Or, the projection may be formed integrally as a substrate including the projections, at a time of manufacturing the substrate of the FPC. The FPCs 50 and 250, and the substrate 51 and 251 in the first embodiment and the second embodiment are formed by a resin material such as polyimide. However, the FPC and the substrate may be formed by any type of material, provided that the material is flexible and insulative. The FPC and substrate may be formed by a rubber for example. Moreover, the ink-jet heads 1 and 200 in the first embodiment and the second embodiment are ink-jet heads of a serial type. However, the ink-jet heads may be line type ink-jet heads. Furthermore, in the first embodiment and the second embodiment, an example in which the present inventions is applied to an ink-jet head which discharges an ink from the nozzle, is given as an example of a liquid discharging head. However, the present invention is also applicable to other liquid discharging heads which discharge a liquid by applying a pressure to a liquid other than ink.

What is claimed is:

1. A liquid discharging head which discharges a liquid, comprising:

a head body including a channel unit in which a plurality of pressure chambers, a plurality of liquid discharge ports, and a plurality of individual liquid channels reaching up to the liquid discharge ports via the pressure chambers respectively, are formed, and a plurality of piezoelectric deformation portions which have individual electrodes facing the pressure chambers respectively, and which are deformed when a predetermined voltage is applied to the individual electrodes; and a flexible flat cable arranged to cover the piezoelectric deformation portions and including a substrate which has a flexibility, in which a projection projecting toward the head body is formed; and a plurality of wires which are extended on the substrate and which are electrically connected to the individual electrodes, wherein the projection is in contact with an area of the head body which is different from areas facing the pressure chambers.

2. The liquid discharging head according to claim 1, wherein the projection is formed as a bent portion of the flexible flat cable which is bent to project toward the head body.

3. The liquid discharging head according to claim 1, wherein the head body includes an actuator unit which includes the piezoelectric deformation portions and a piezoelectric layer which is formed to cover the pressure chambers and which supports the individual electrodes, and the projection is in contact with an area, on a surface of the actuator unit, which is different from areas facing the pressure chambers.

4. The liquid discharging head according to claim 3, wherein the pressure chambers have an elongated shape, and form a row of the pressure chambers which is arranged in a direction orthogonal to a longitudinal direction of the pressure chambers, and the projection is in contact with a point area which is located in the vicinity of one end of the surface of the actuator unit in the longitudinal direction of the pressure chambers, and which is also located between two adjacent pressure chambers in a direction orthogonal to the longitudinal direction; and a width of the point area in the direction orthogonal to the longitudinal direction is not more than a distance between the two adjacent pressure chambers.

5. The liquid discharging head according to claim 3, wherein the pressure chambers have an elongated shape, and form a row of the pressure chambers which is arranged in a direction orthogonal to the longitudinal direction of the pressure chambers, and the projection includes a first projection and a second projection, the first projection being in contact with a first point area which is located in the vicinity of one end of the surface of the actuator unit in the longitudinal direction of the pressure chambers, and which is also located between two adjacent pressure chambers in the direction orthogonal to the longitudinal direction, and the second projection being in contact with a second point area which is located in the vicinity of the other end of the surface of the actuator unit in the longitudinal direction of the pressure chambers, and which is also located between the two adjacent pressure chambers in the direction orthogonal to the longitudinal direction, and a width of the first point area in the direction orthogonal to the longitudinal direction is not more than a distance between the two adjacent pressure chambers, and a width of the second point area in the direction orthogonal to the longitudinal direction is not more than a distance between the two adjacent pressure chambers.

6. The liquid discharging head according to claim 5, wherein the first projection and the second projection are formed so as to include a plurality of first projections and a plurality of second projections respectively, and the first projections and the second projections are formed at uniform distance in the direction orthogonal to the longitudinal direction.

7. The liquid discharging head according to claim 6, wherein the first projections and the second projections are arranged alternately in the direction orthogonal to the longitudinal direction, so as to be arranged in a zigzag form.

8. The liquid discharging head according to claim 3, wherein the pressure chambers have an elongated shape and form a row of the pressure chambers which is arranged in a direction orthogonal to a longitudinal direction of the pressure chambers, and the projection is formed to have a long shape extended along the direction orthogonal to the longitudinal direction of the pressure chambers, and is in contact with an elongated area, which is located in the vicinity of one end of the surface of the actuator unit in the longitudinal direction of the pressure chambers belonging to the row of the pressure chambers, and which is extended in the direction orthogonal to the longitudinal direction.

9. The liquid discharging head according to claim 3, wherein the pressure chambers have an elongated shape, and form a row of the pressure chambers which is arranged in a direction orthogonal to a longitudinal direction of the pressure chambers, and the projection is formed to have a ring shape and is in contact with a ring shaped area which is located on the surface of the actuator unit, and which surrounds a pressure chamber among the pressure chambers belonging to the row of the pressure chambers.

10. The liquid discharging head according to claim 3, wherein the pressure chambers have an elongated shape, and form a row of the pressure chambers which is arranged in a direction orthogonal to a longitudinal direction of the pressure chambers, and the projection is formed to have a shape of a ladder, and is in contact with two elongated areas and a contacting area, the elongated areas being located in proximity to one end and the other end of the surface of the actuator unit in the longitudinal direction of the pressure chambers belonging to the row of the pressure chambers, and the elongated areas being extended in the direction orthogonal to the longitudinal direction, and the connecting area being located in a portion of the surface of the actuator unit corresponding between two pressure chambers among the pressure chambers is extended, and the connecting area connecting the two elongated areas.

11. The liquid discharging head according to claim 1, wherein the substrate is formed of a resin material, and the projection is formed by a pressing process.

12. A flexible flat cable of a liquid discharging head connected to a head body including a channel unit in which a plurality of pressure chambers, a plurality of liquid discharge ports, and a plurality of individual liquid channels reaching up to the liquid discharge ports via the pressure chambers respectively, are formed, and a plurality of piezoelectric deformation portions having individual electrodes facing the pressure chambers respectively, the flexible flat cable covering the piezoelectric deformation portions, and supplying a driving signal to a plurality of individual electrodes, the flexible flat cable comprising:

a substrate which has a flexibility, which makes a contact with an area which does not face the pressure chambers when connected to the head main body, and in which a projection projecting toward the head main body is formed; and a plurality of wires which are extended on the substrate and are electrically connected to the individual electrodes respectively.

13. The flexible flat cable of the liquid discharging head according to claim 12, wherein the projection is formed as a bent portion of the flexible flat cable which is bent to project toward the head body.

14. A printer which records an image on a recording medium by discharging an ink, comprising:

a liquid discharging head having a head body including a channel unit in which a plurality of pressure chambers, a plurality of liquid discharge ports, and a plurality of individual liquid channels reaching up to the liquid discharge ports via the pressure chambers respectively, are formed, and a plurality of piezoelectric deformation portions which has individual electrodes facing the pressure chambers, and which are deformed when a predetermined voltage is applied to the individual electrodes; and a flexible flat cable arranged to cover the piezoelectric deformation portions and including a substrate which has a flexibility and on which a projection projecting toward the head body is formed, and a plurality of wires extended on the substrate and electrically connected to the individual electrodes, a carriage which is movable while supporting the liquid discharging head; and a control mechanism which is connected to one end of the flexible flat cable, which supplies a predetermined voltage to the individual electrodes, and which supplies a signal to the carriage for controlling a drive of the carriage, wherein the projection is in contact with an area of the head body which is different from areas facing the pressure chambers.

* * * * *